US007984803B2

(12) United States Patent
Anderson et al.

(10) Patent No.: US 7,984,803 B2
(45) Date of Patent: Jul. 26, 2011

(54) HANGING DISPLAY PACKAGE AND ASSOCIATED PRODUCTS AND METHODS

(75) Inventors: Neal T. Anderson, Edina, MN (US); Eric Bjerstedt, Minneapolis, MN (US); Brandon R. Ferraro, St. Louis Park, MN (US); Timothy M. Magner, Champlin, MN (US); Jeffrey P. Pratsch, Jr., Crystal, MN (US); Jake Strassberger, South Plainfield, NJ (US); Keith C. Cedro, Clifton, NJ (US)

(73) Assignee: Target Brands, Inc., Minneapolis, MN (US)

( * ) Notice: Subject to any disclaimer, the term of this patent is extended or adjusted under 35 U.S.C. 154(b) by 62 days.

(21) Appl. No.: 12/480,994

(22) Filed: Jun. 9, 2009

(65) Prior Publication Data

US 2010/0307936 A1 Dec. 9, 2010

(51) Int. Cl.
*B65D 5/42* (2006.01)
*B65B 5/04* (2006.01)

(52) U.S. Cl. ..... 206/284; 206/278; 53/396; 53/411

(58) Field of Classification Search ..... 206/278, 206/287.1, 289, 806, 284, 296, 297, 459.1; 223/88, 96, 9, 99; 24/578.13; 53/396, 411
See application file for complete search history.

(56) References Cited

U.S. PATENT DOCUMENTS

D118,984 S 2/1940 Paterson
2,320,018 A * 5/1943 Ullman ..... 229/120.18
D140,337 S 2/1945 Hill
D140,338 S 2/1945 Hill
D153,032 S 3/1949 Porter
2,912,150 A * 11/1959 Shapiro ..... 223/98
3,087,605 A 4/1963 Kester
3,172,531 A 3/1965 Shillman
3,191,770 A 6/1965 Zuckerman
3,435,999 A * 4/1969 Mantell ..... 223/91
3,477,623 A 11/1969 Milette et al.
3,557,944 A * 1/1971 Crane ..... 206/287
3,680,746 A * 8/1972 Seckelmann ..... 223/88
3,710,996 A * 1/1973 Smilow et al. ..... 223/87
3,841,478 A 10/1974 Wells et al.
3,862,687 A 1/1975 Pirman
3,963,154 A 6/1976 Schwartz et al.
4,177,908 A * 12/1979 Batts et al. ..... 223/96
4,198,772 A * 4/1980 Furutu ..... 40/665
D272,502 S 2/1984 Batts et al.
4,526,306 A 7/1985 Zuckerman et al.
D296,046 S 6/1988 Marshall
D299,086 S 12/1988 Wilson
D301,661 S 6/1989 Wilson
D301,942 S 7/1989 Talbot-Titley
(Continued)

*Primary Examiner* — Sue A Weaver
(74) *Attorney, Agent, or Firm* — Griffiths & Seaton PLLC

(57) ABSTRACT

A hanging display package includes a hanger and a box. The hanger defines a top segment and a bottom segment spaced from and coupled with the top segment and includes a hook extending upwardly from the top segment. The box includes front and rear panels, a top panel extending between and above the front and rear panels, and a side panel extending from the front panel to the rear panel. A cavity is defined between the panels. The top panel borders each of the front and rear panels along first and second fold lines, respectively, and is substantially planar. The side panel defines a topmost edge spaced below the top panel such that a side opening is defined between the topmost edge and the front panel. The bottom segment of the hanger extends through the side opening. Other products, assemblies, and methods are also disclosed.

23 Claims, 13 Drawing Sheets

U.S. PATENT DOCUMENTS

| | | | | | |
|---|---|---|---|---|---|
| D301,943 | S | | 7/1989 | Wilson | |
| D302,214 | S | | 7/1989 | Wilson | |
| D303,324 | S | | 9/1989 | Wilson | |
| D303,325 | S | | 9/1989 | Marshall | |
| 4,865,236 | A | | 9/1989 | Dongas | |
| 4,889,265 | A | * | 12/1989 | Morgan | 223/96 |
| 4,901,894 | A | * | 2/1990 | Blanchard | 223/96 |
| D371,246 | S | | 7/1996 | Gouldson et al. | |
| 5,556,014 | A | * | 9/1996 | Kolton et al. | 223/85 |
| D375,208 | S | | 11/1996 | Gouldson | |
| 5,615,810 | A | * | 4/1997 | Kolton et al. | 223/85 |
| 5,758,806 | A | | 6/1998 | Anderson | |
| D400,718 | S | | 11/1998 | Bortolus | |
| D405,343 | S | | 2/1999 | Oberdorf | |
| 5,868,289 | A | | 2/1999 | Lee | |
| D408,156 | S | | 4/1999 | Eiley et al. | |
| D415,620 | S | | 10/1999 | Prince et al. | |
| 6,085,950 | A | | 7/2000 | Gouldson et al. | |
| 6,142,347 | A | | 11/2000 | Kolton et al. | |
| 6,237,762 | B1 | | 5/2001 | Faircloth | |
| D445,265 | S | | 7/2001 | Yost | |
| 6,286,735 | B1 | | 9/2001 | Zuckerman | |
| 6,508,357 | B1 | | 1/2003 | Faircloth et al. | |
| 6,581,765 | B1 | | 6/2003 | Rhyne | |
| 6,612,431 | B2 | | 9/2003 | Faircloth | |
| 6,772,880 | B2 | | 8/2004 | Beverly | |
| D499,560 | S | | 12/2004 | Abdi et al. | |
| D501,093 | S | | 1/2005 | Barre et al. | |
| D504,577 | S | | 5/2005 | Mann | |
| D513,595 | S | | 1/2006 | Weber et al. | |
| 6,981,588 | B2 | | 1/2006 | Kimura | |
| D527,536 | S | | 9/2006 | McCoy et al. | |
| 7,264,115 | B1 | * | 9/2007 | Uittenbogaard et al. | 206/293 |
| D560,373 | S | | 1/2008 | Gouldson | |
| D567,518 | S | | 4/2008 | Gouldson | |
| 7,513,366 | B1 | | 4/2009 | Keating | |
| 2002/0108975 | A1 | | 8/2002 | Hunt et al. | |
| 2003/0209577 | A1 | | 11/2003 | Gouldson et al. | |
| 2004/0050727 | A1 | | 3/2004 | Fraistat et al. | |
| 2007/0045130 | A1 | | 3/2007 | Kim | |
| 2007/0045136 | A1 | | 3/2007 | Kim | |

* cited by examiner

HANGING DISPLAY PACKAGE AND ASSOCIATED PRODUCTS AND METHODS

CROSS REFERENCE TO RELATED APPLICATION

This application is related to United States Design Pat. Application No. 29/338,303, entitled "HANGER," filed on Jun. 9, 2009, which is incorporated herein by reference.

BACKGROUND OF THE INVENTION

Retailers are continually evolving product displays in hopes of discovering more effective and visually attractive means for displaying products to potential consumers. The packaging for products may be designed to facilitate product display. For example, given the limited shelf space available in retail stores, it is often desirable to provide product packaging configured to facilitate hanging of products from rods, pegs, or other display fixture support members.

SUMMARY OF THE INVENTION

One aspect of the present invention relates to a hanging display package including a hanger and a box. The hanger defines a top segment and a bottom segment spaced from and coupled with the top segment and includes a hook extending upwardly from the top segment. The box includes a front panel, a rear panel opposite the front panel, a top panel extending between and above the front panel and the rear panel, and a side panel extending from the front panel to the rear panel to define a box cavity between the front panel, the rear panel, the top panel, and the side panel. The top panel borders the front panel along a first fold line, and the top panel borders the rear panel along a second fold line substantially parallel to the first fold line, and the top panel is substantially planar. The side panel defines a topmost edge spaced below the top panel, the first fold line, and the second fold line such that a side opening is defined between the topmost edge and the top panel and such that the front panel and the rear panel each extend partially above the side panel. The bottom segment of the hanger extends through the box cavity and the side opening, and the top segment of the hanger extends above the top panel of the box. Other related products, assemblies and methods are also disclosed and provide additional advantages.

BRIEF DESCRIPTION OF THE DRAWINGS

Embodiments of the invention will be described with respect to the figures, in which like reference numerals denote like elements, and in which.

DETAILED DESCRIPTION

Figure 1:
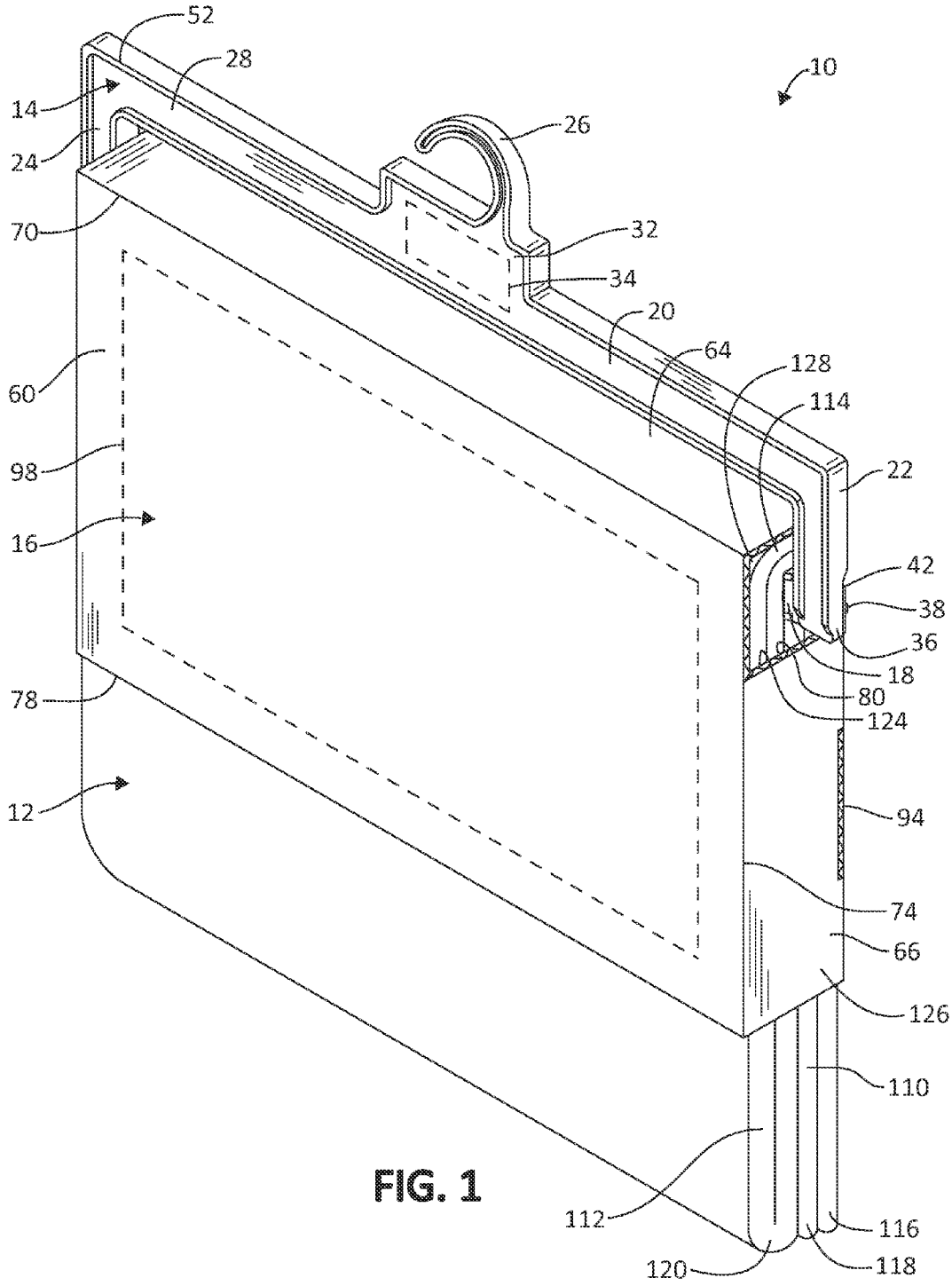
FIG. 1 is a front, perspective view illustrating a packaged product, according to one embodiment of the present invention.
Figure 2:
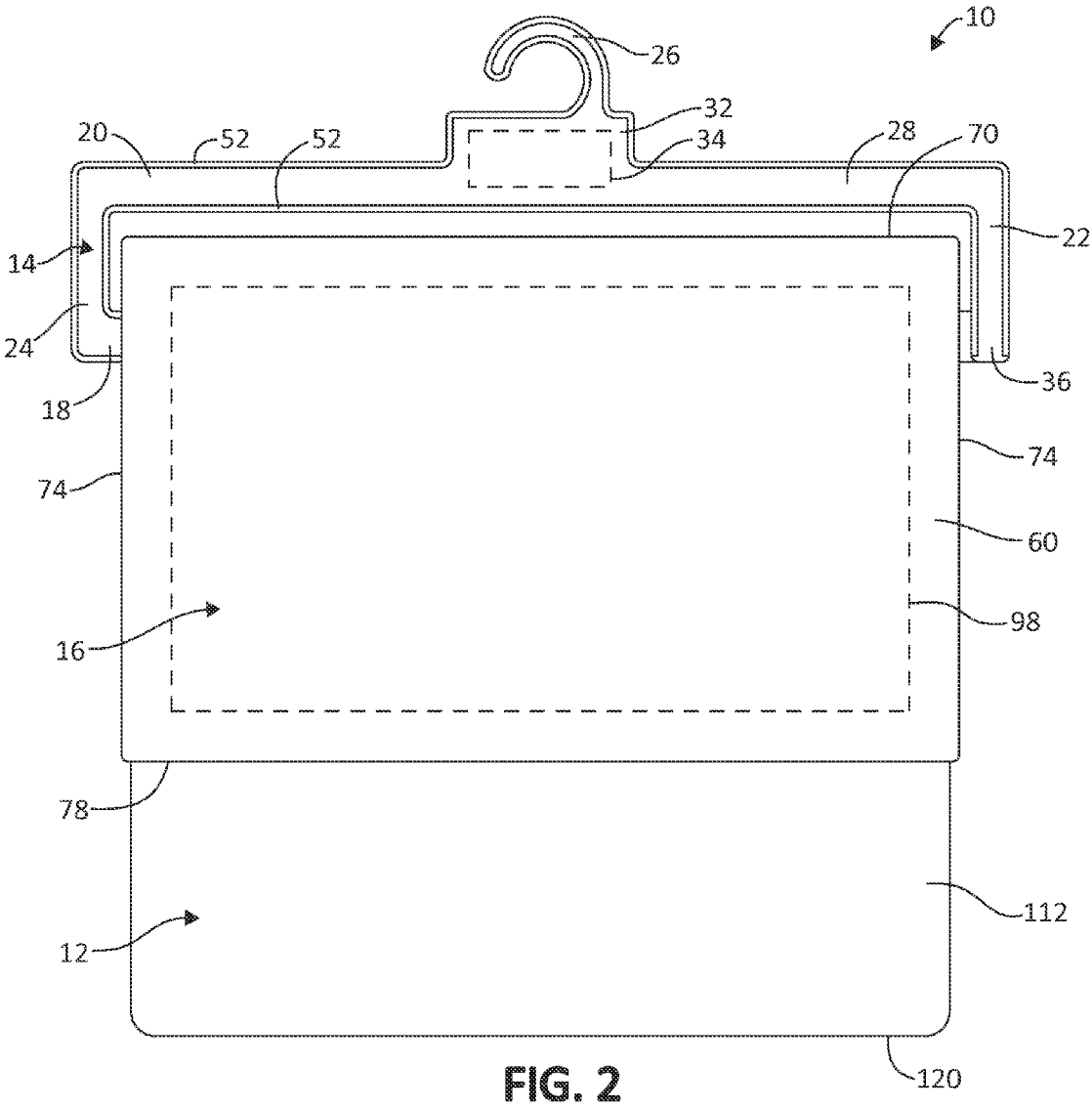
FIG. 2 is a front view of the packaged product of FIG. 1, according to one embodiment of the present invention.

Embodiments of the present invention are configured to at least partially wrap an article for retail sale and to facilitate hanging the article from a retail display fixture. More specifically, the article is hung from a hanger and is at least partially wrapped in a box, which also extends over at least a portion of the hanger. The hanger facilitates hanging of the article while the box protects the article and provides display area for supporting artwork, product information, promotional material, branding, etc. Such packaging is particularly advantageous in the area of fabric-based home goods (e.g., curtains, tablecloths, napkins, and other linens) and/or suitable fabric-based clothing goods (e.g., scarves, socks, stockings, etc.). Such fabric-based home goods are conventionally wrapped in substantially or entirely non-recyclable polyvinyl bags. By replacing polyvinyl bags with a composite assembly including readily recyclable corrugated cardboard and a more environmentally friendly plastic hanger (e.g., for example, as described in more detail below), associated manufacturers and/or retailers are making ecologically responsible contributions to the long-term well being of the planet.

Turning to FIGS. 1-7, according to one embodiment of the invention, a packaged product 10 includes an article 12 for retail sale, a hanger 14, and a sheath or box 16. Article 12 is any fabric-based or other merchandise of a substantially flexible nature. For example, article 12 is formed of a woven or non-woven fabric configured to be folded or similarly manipulated into a substantially smaller shape than when entirely unfolded. In one embodiment, article 12 includes at least one of a fabric-based home good item (e.g., a tablecloth, napkin, table runner, curtain, drape, valance, sheet, pillow sham, or similar item), a suitable fabric-based clothing item (e.g., a scarf, stocking, or sock item), or other similar item offered for retail sale. Hanger 14 is configured to hang from a retail display while holding article 12. Box 16 wraps around at least a portion of each of article 12 and hanger 14 to enclose a portion thereof. Box 16 protects article 12, more securely holds article 12 relative to hanger 14, and provides surface area for display of promotional and/or informational indicia relating to article 12.

In one embodiment, hanger 14 includes a bottom segment 18, a top segment 20, a first side segment 22, and a second side segment 24. In one example, bottom segment 18, top segment 20, first side segment 22, and second side segment 24 are each substantially linear and collectively define a substantially rectangular frame structure. In particular, first side segment 22 extends upwardly from a free end 36 of first side segment 22. Top segment 20 extends from first side segment 22 opposite free end 36 in a direction substantially perpendicular to first side segment 22. Second side segment 24 extends downwardly from top segment 20 opposite and substantially parallel to first side segment 22. Bottom segment 18 extends from second side segment 24 opposite and substantially parallel to top segment 20 toward free end 36 of first side segment 22. Bottom segment 18 defines a free end 42 opposite second side segment 24. When in an initial position (i.e., closed, but not locked in place), free end 42 overlaps free end 36 of first side segment 22.

Although described above and illustrated as being a rectangular frame shape, in one embodiment, first and second side segments 22 and 24 need not be parallel to one another; for example, they may both angle inwardly toward one another or outwardly away from one another as they extend downwardly from top segment 20. In one example, one or more of bottom segment 18, top segment 20, first side segment 22, and second side segment 24 is curvilinear, angled, or otherwise shaped in a non-linear or at least partially non-linear manner. Other variations will be apparent to those of skill in the art upon reading this application.

In one embodiment, bottom segment 18, top segment 20, first side segment 22, and second side segment 24 are each substantially planar other than ribs 52 such that each segment 18, 20, 22, and 24 defines a portion of a substantially planar first or front surface 28 and an opposite, substantially planar, second or rear surface 30. In one example, ribs 52 extend perpendicular to the surfaces 28 and 30 along each outer edge of the associated segment 18, 20, 22, and 24 to increase strength of hanger 14.

A hook 26 extends upwardly away from top segment 20 and, in one example, is longitudinally centered along top segment 20. In one embodiment, hook 26 is substantially curvilinear and open to receive and hang from a supporting structure as will be further described below. In one example, an intermediate or extension portion 32 extends away from top segment 20, and hook 26 extends upwardly from extension portion 32 where both extension portion 32 and hook 26 are longitudinally centered relative to top segment 20. In one embodiment, extension portion 32 defines a substantially planar surface area that is substantially coplanar with at least a portion of each of front surface 28 and rear surface 30 defined by top segment 20 to create an area for supporting promotional, informational, branding or other indicia 34 (generally indicated in the figures as a dashed box). Indicia 34 may be embossed, molded, or otherwise formed integrally with hanger 14 or may be printed directly to or printed to a label applied to hanger 14 as will be apparent to those of skill in the art upon reading this application.

In one embodiment, free end 36 of first side segment 22 and free end 42 of bottom segment 18 are configured to be selectively coupled with one another. When free ends 36 and 42 are uncoupled, bottom segment 18 can be pulled away from first side segment 22 as illustrated by the arrow in FIG. 8 to create a space between free ends 36 and 42 to more easily allow portions of article 12 and box 16 to be placed over bottom segment 18. In one embodiment, a protruding pin 38 extends from a portion of rear surface 30 defined by first side segment 22 in a direction substantially perpendicular to rear surface 30. A knob or enlarged end 40 is defined on an end of pin 38 opposite first side segment 22. In one example, ribs 52 each terminate before reaching free end 36. More specifically, in one example, ribs 52 terminate, at least on rear surface 30 of first side segment 22, a distance from free end 36 equal to at least a height (i.e., a distance up and down relative to FIGS. 1-8) of bottom segment 18 near free end 42.

In one embodiment, free end 42 includes a cone-shaped receptacle 44 extending away from rear surface 30 of bottom segment 18 for receiving pin 38. In one example, receptacle 44 is centered along a height of bottom segment 18. Receptacle 44 defines an aperture 46 through a center thereof with a diameter larger than a shaft portion of pin 38 and slightly smaller than enlarged end 40. In one embodiment, deflection slits 48 are defined by receptacle 44, are circumferentially spaced from one another, and each radially extend outwardly from aperture 46. Deflection slits 48 facilitate deflection of receptacle 44 to selectively stretch the diameter of aperture 46 allowing enlarged end 40 of pin 38 to pass through aperture 46 when enlarged end 40 is pushed toward receptacle 44 and/or vice versa. In one embodiment, hanger 14 is formed of a material with sufficient elasticity that receptacle 44 generally returns to its original, non-deflected position once force from pin 38 is removed.

Figure 8:
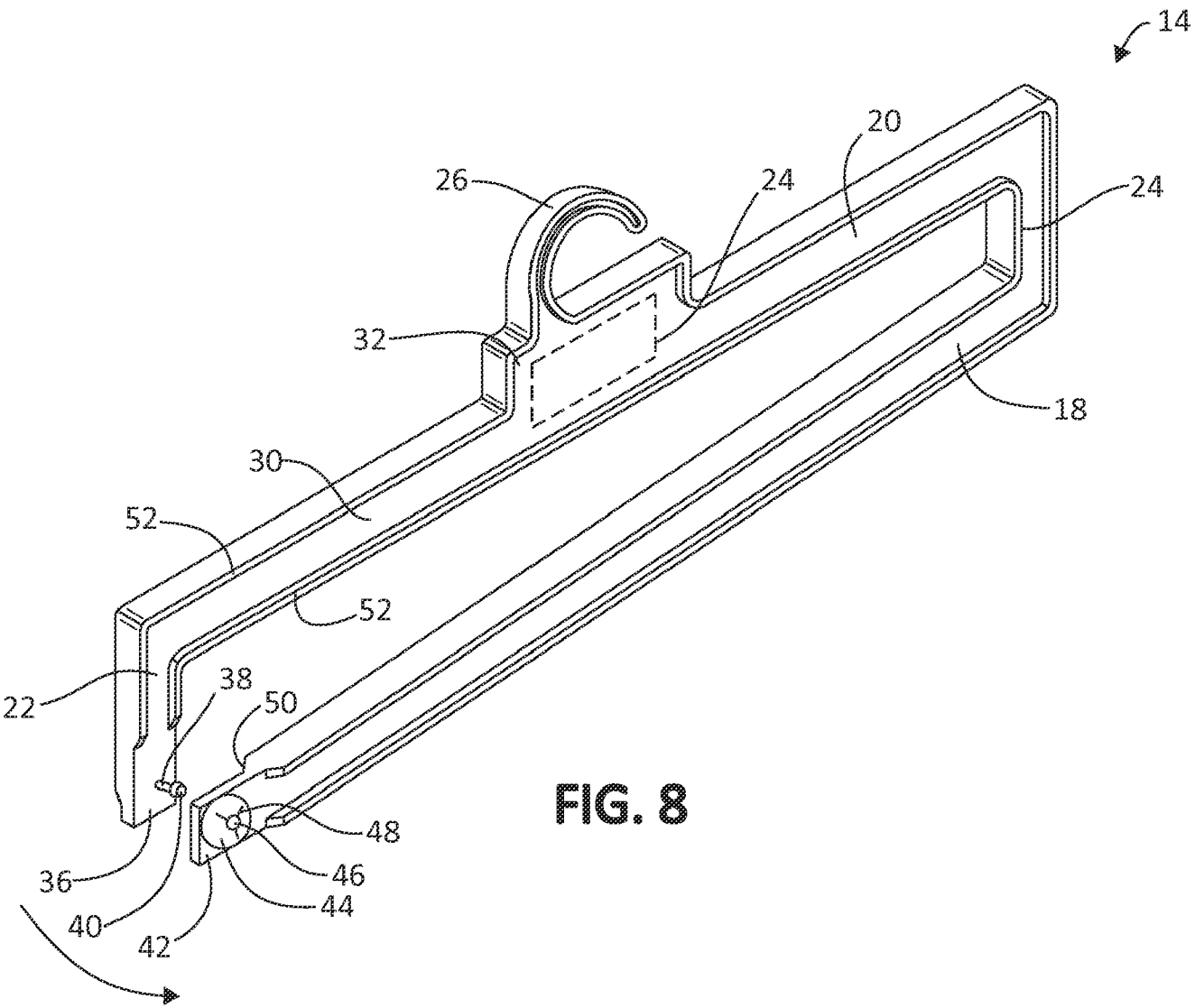
FIG. 8 is a rear, perspective view of a hanger from the packaged product of FIG. 1 in an open position, according to one embodiment of the present invention.

In its initial state, free end 42 extends across and just behind free end 36 such that pin 38 aligns with aperture 46 of receptacle 44. Hanger 14, or at least bottom segment 18, is formed of a material allowing free end 42 of bottom segment 18 to be rotated rearwardly away from free end 36 of first side segment 22 (e.g., as generally indicated by the arrow in FIG. 8) into an open position as illustrated in FIG. 8. When rotated away from free end 36, article 12 can relatively easily be slid over or otherwise positioned to extend over bottom segment 18 of hanger 14.

When the rotational force is removed, bottom segment 18 returns to its initial state due in part to the elasticity of the material used to form hanger 14 or at least bottom segment 18. Following return to the initial state, enlarged end 40 is pushed through receptacle 44 to selectively lock or otherwise maintain hanger 14 in a closed position (FIGS. 1-7) with free ends 36 and 42 positioned immediately adjacent (e.g., abutting) one another. In the closed position, hanger 14 defines a generally rectangular opening between bottom segment 18, top segment 20, first side segment 22, and second side segment 24.

In one embodiment, ribs 52, which otherwise extend along the top and bottom of bottom segment 18, terminate near free end 42 to form a cutout or thinning 50 of free end 42 such that ribs 52 do not interfere with receptacle 44 or the interaction between pin 38 and receptacle 44. In this manner, when hanger 14 is in a closed position, the portion of front surface 28 defined by bottom segment 18 abuts a portion of rear surface 30 defined by free end 36. In one embodiment, a thickness cutout or thinning 50 other than mere termination of ribs 52 may also or alternatively be formed near free end 42 to facilitate selective coupling of free ends 36 and 42 in a manner allowing bottom segment 18 to extend substantially parallel with top segment 20. Although primarily described herein as including pin 38 on first side segment 22 and receptacle 44 and cutout 50 on bottom segment 18, upon reading this application, one of skill in the art will recognize that alternative configurations (e.g., forming pin 38 on a portion of front surface 28 defined by bottom segment 18 and/or receptacle 44 on a portion of front surface 28 defined by first side segment 22) are also acceptable.

Hanger 14 is formed of any suitable material such as injection molded plastic (e.g., polypropylene) with the desired elastomeric properties to allow manipulation of bottom segment 18. In one example, hanger 14 is formed of a plastic that is readily recyclable. Other materials for and methods of forming hanger 14 will be apparent to those of skill in the art upon reading the present application.

Figure 9:
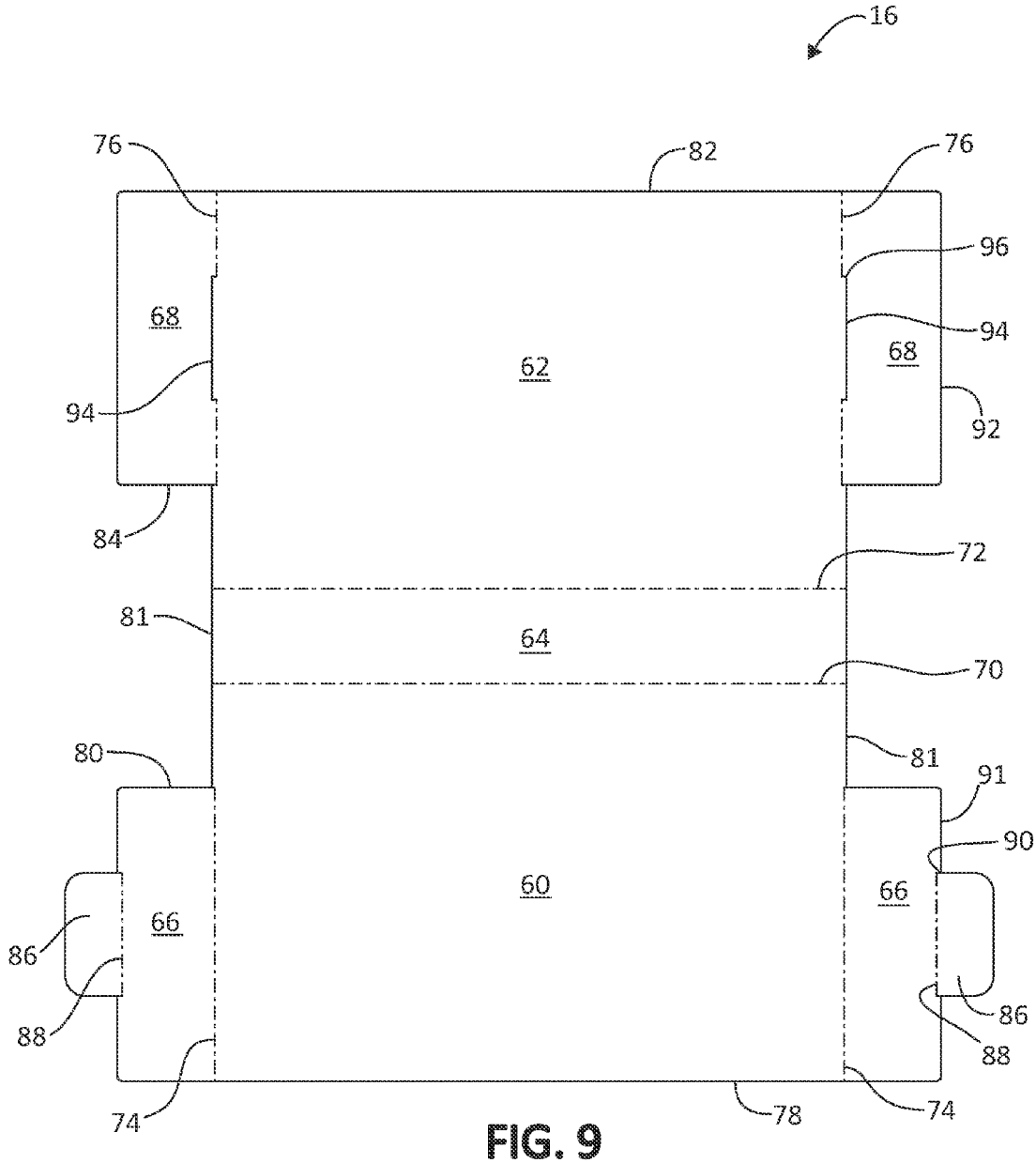
FIG. 9 is a front view of an unfolded blank for forming a box of the packaged product of FIG. 1, according to one embodiment of the present invention.

Box 16 is sized and shaped for use with hanger 14 to wrap at least a portion of article 12 for retail sale. In one embodiment, box 16 is folded from a single planar blank of appropriate material, such as paperboard, chipboard, corrugated cardboard, etc. as illustrated in FIG. 9. In one example, box 16 is formed from a readily recyclable material to reduce the environmental impact of box manufacture. Referring to the blank of FIG. 9, box 16 defines a plurality of panels or walls separated from each other by one or more fold lines. More specifically, box 16 defines a first primary or front panel 60, a second primary or rear panel 62, an intermediate or top panel 64, first side panels 66, and second side panels 68.

As illustrated in FIG. 9, rear panel 62 is positioned longitudinally opposite front panel 60, and top panel 64 extends between front panel 60 and rear panel 62. Top panel 64 has a width smaller, in one embodiment, just slightly smaller, than a width of an opening formed by hanger 14 between first side segment 22 and second side segment 24. In one example, top panel 64 is separated from front panel 60 by a laterally extending fold line 70 and from rear panel 62 by a laterally extending fold line 72. In one embodiment, front panel 60 and rear panel 62 respectively define laterally extending free edges 78 and 82 opposite top panel 64. In one embodiment, front, rear, and top panels 60, 62, and 64 are of similar (e.g., identical) widths and collectively define a longitudinally extending, free side edge 81 on either side thereof. In one example, front panel 60 is substantially similar in size and shape to rear panel 62.

A first side panel 66 laterally extends outwardly from front panel 60 and borders front panel 60 along a longitudinally extending fold line 74. In one embodiment, a portion of side edge 81 defined by front panel 60 extends above fold line 74. In one example, fold line 74 is slightly laterally inset from side edge 81 of front panel 60 by a distance similar to a thickness of the box blank (i.e., the unfolded box 16) such that, when folded, first side panel 66 will fit just inside side edge 81 of front panel 60 as illustrated, for example, in FIGS. 1-5.

In one embodiment, first side panel 66 partially defines free edge 78 along with front panel 60 where free edge 78 laterally extends in a substantially linear manner substantially parallel to fold lines 70 and 72. In one example, first side panel 66 is shorter than front panel 60 such that first side panel 66 terminates opposite free edge 78 at a top free edge 80 (e.g., a topmost edge of first side panel 66) positioned lower than fold line 70 in the FIG. 9 illustration and in the folded configuration of FIGS. 1-7. For example, top free edge 80 is positioned about one inch or further away from fold line 70. Otherwise stated, while front panel 60 extends substantially continuously from free edge 78 to fold line 70, first side panel 66 stops short of fold line 70. In one embodiment, top free edge 80 extends substantially parallel to fold line 70.

A tab 86 extends from side panel 66 laterally outwardly opposite front panel 60. A longitudinally extending fold line 88 is defined between first side panel 66 and tab 86. In one embodiment, fold line 88 is inset from a longitudinally extending, outer side edge 91 of first side panel 66, and a slit 90 extends inwardly from outer side edge 91 to fold line 88. The offset of fold line 88 and slit 90 allows tab 86 to be folded relative to first side panel 66 such that the folded tab 86 will extend from first side panel 66 within the lateral confines of first side panel 66. In one example, a single tab 86 is substantially longitudinally centered relative to first side panel 66. In one example, instead of a single tab 86 as illustrated, two or more tabs (not shown) similar to single tab 86 may extend laterally outwardly from first side panel 66 longitudinally spaced from one another along outer side edge 91 as will be apparent to those of skill in the art upon reading this application. Another substantially similar first side panel 66 is formed on an opposite side of front panel 60 as illustrated in FIG. 9 in a substantially symmetrical manner.

A second side panel 68 laterally extends outwardly from rear panel 62 to a longitudinally extending, outer side edge 92. Second side panel 68 borders rear panel 62 along a longitudinally extending fold line 76. In one example, the distance between fold line 76 and outer side edge 92 is substantially similar to or slightly smaller than a distance defined by first side panel 66 between fold line 74 and outer side edge 91. In one embodiment, a portion of side edge 81 defined by rear panel 62 extends above fold line 74 when box 16 is folded (below fold line 74 in the orientation of unfolded blank as illustrated in FIG. 9). In one example, fold line 76 is slightly laterally inset from side edge 81 of rear panel 62 by a distance similar to a thickness of the box blank (i.e., the unfolded box 16) such that when folded, second side panel 68 will fit just inside the portion of side edge 81 defined by rear panel 62 as illustrated with additional reference to FIGS. 1-7.

In one embodiment, second side panel 68 partially defines free edge 82 along with rear panel 62 where free edge 82 laterally extends in a substantially linear manner. In one example, second side panel 68 is shorter than rear panel 62 such that second side panel 68 terminates opposite free edge 82 at a top free edge 84 (e.g., a topmost edge of second side panel 68) positioned lower than fold line 70 when box 16 is folded (i.e., higher than fold line 70 in the unfolded orientation illustrated in FIG. 9). For instance, in one example, top free edge 84 is positioned about one inch or further away from fold line 72 and, in one embodiment, a similar or further distance from fold line 72 as compared to a distance top free edge 80 is positioned from fold line 70. Otherwise stated, while rear panel 62 extends substantially continuously from free edge 82 to fold line 72, second side panel 68 stops well short of fold line 72. In one example, first side panel 66 and second side panel 68 are of substantially similar heights or second side panel 68 is slightly shorter in height than first side panel 66.

Figure 3:
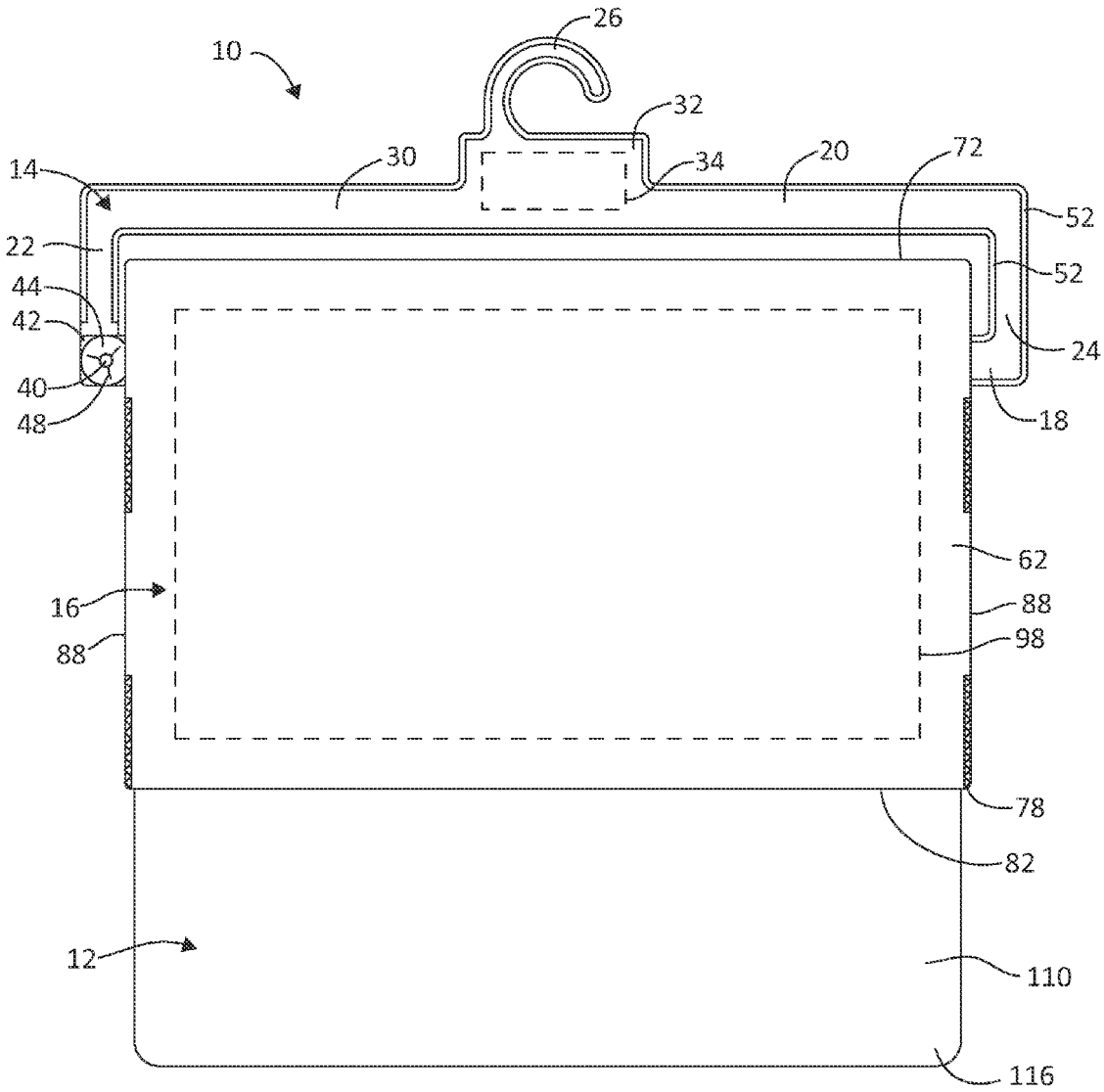
FIG. 3 is a rear view of the packaged product of FIG. 1, according to one embodiment of the present invention.
Figure 4:
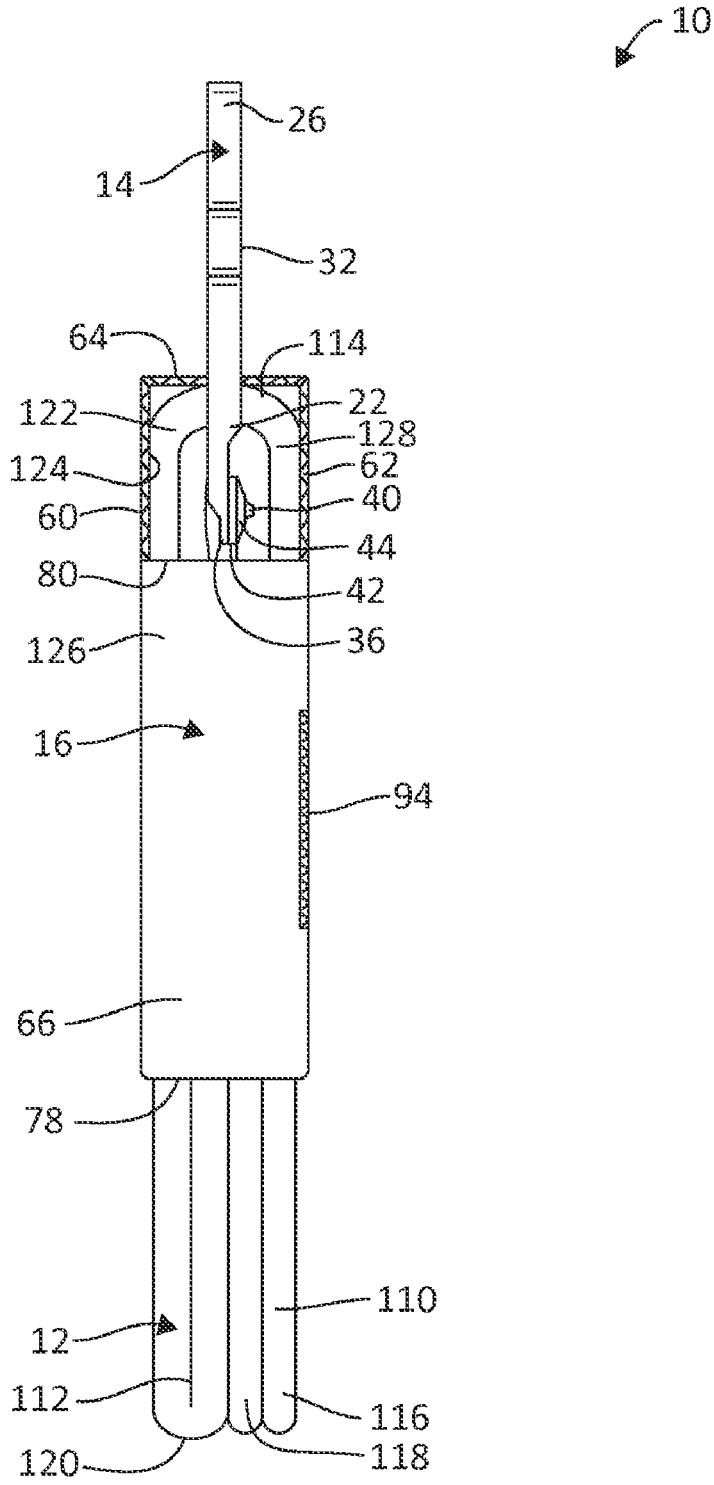
FIG. 4 is a right side view of the packaged product of FIG. 1, according to one embodiment of the present invention.
Figure 5:
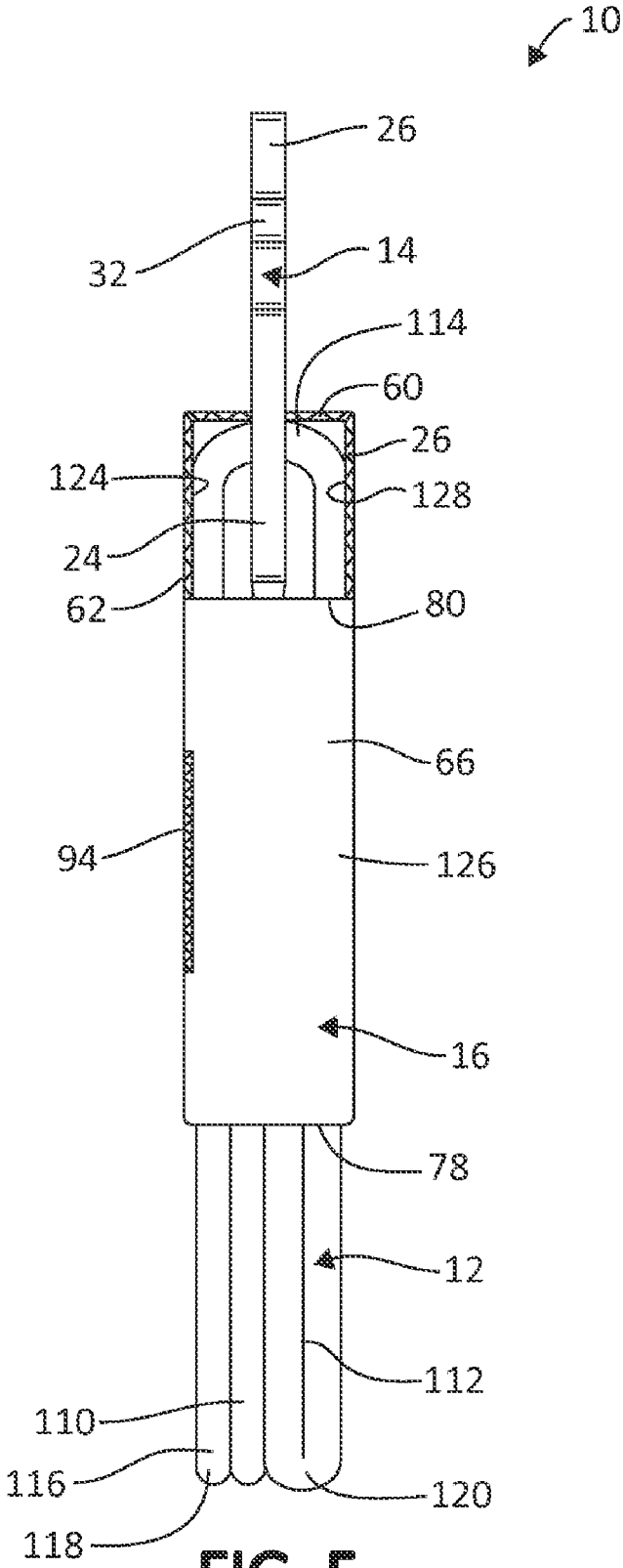
FIG. 5 is a left side view of the packaged product of FIG. 1, according to one embodiment of the present invention.
Figure 6:
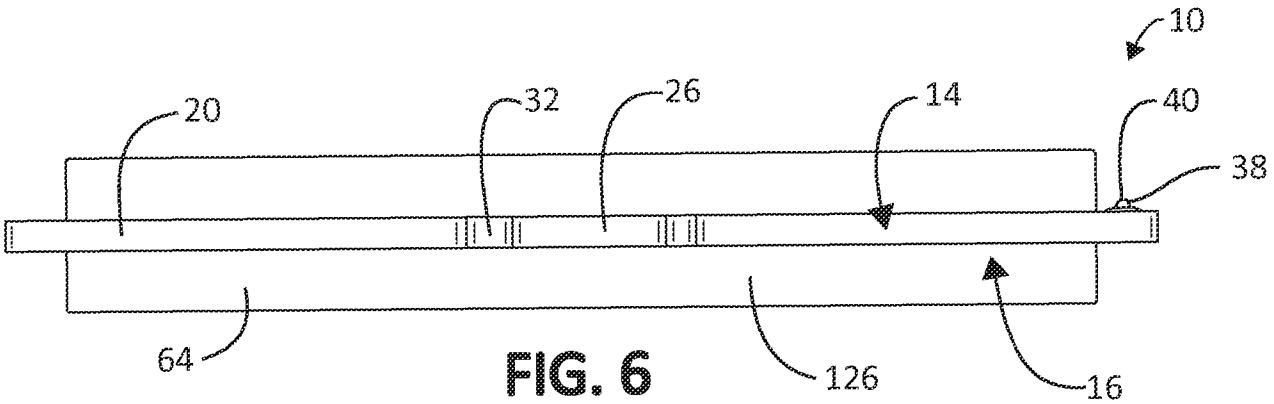
FIG. 6 is a top view of the packaged product of FIG. 1, according to one embodiment of the present invention.
Figure 7:
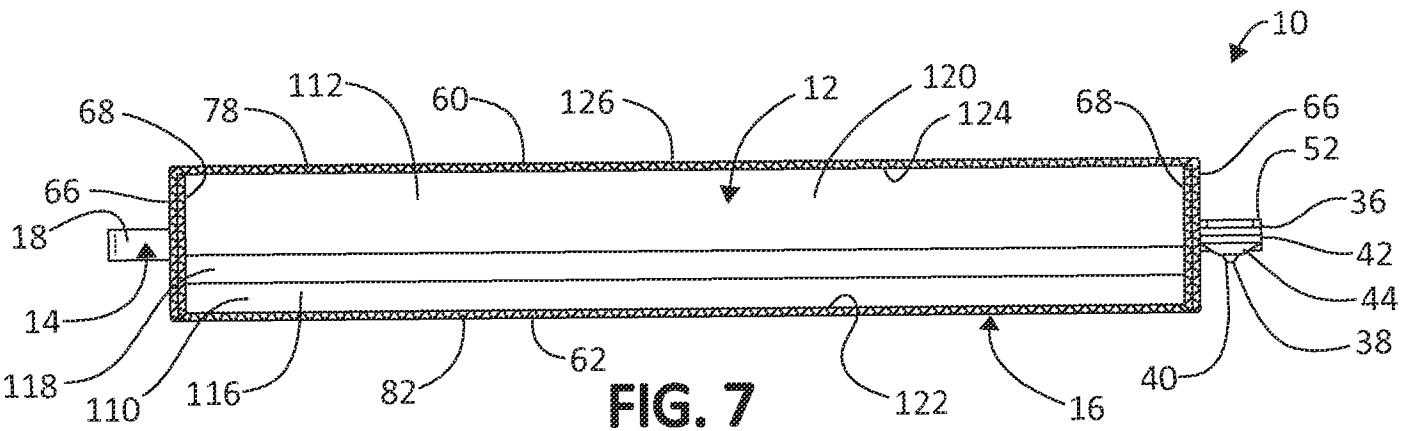
FIG. 7 is a bottom view of the packaged product of FIG. 1, according to one embodiment of the present invention.

In one embodiment, a slit 94 is formed substantially along fold line 76 in a position to correspond with the location of tab 86 on a corresponding first side panel 66 when box 16 is folded. Slit 94 has a longitudinal length similar to, but slightly larger than, a longitudinal length of corresponding tab 86. In one embodiment, slit 94 is slightly laterally offset outwardly from fold line 76 by laterally extending slit 96. In one example, slit 96 offsets slit 94 from fold line 76 by a distance substantially equal to a thickness of the box blank. The offset of slit 94 allows for a straight side edge appearance of box 16 when box 16 is folded as illustrated in FIG. 3. In one embodiment, a second one of second side panels 68 is similarly formed on an opposite side of rear panel 62 in a substantially symmetrical manner. Although primarily described as extending from front panel 60 and rear panel 62, respectively, in one embodiment, first side panel 66 extends from rear panel 62 and second side panel 68 extends from front panel 60.

In one embodiment, indicia, which is generally indicated by dashed box 98 in FIG. 1, is included on box exterior surface 126. In one example, indicia 98 is included on any one or more of front panel 60, rear panel 62, top panel 64, and side panels 66 and 68. Indicia 98 generally includes promotional, identification, description, and/or other information regarding article 12 (e.g., dimensions of article 12, a picture of article 12, a brand associated with article 12, and/or other depiction or text).

To assemble packaged product 10, article 12 is folded into a desired configuration. More specifically, article 12 is folded into a depth slightly smaller than a depth (extension in the lateral direction as described with respect to claim 9) of box cavity 122 measured between front panel 60 and rear panel 62. Then, article 12 is folded into at least two portions (for example, first portion 110 and second portion 112) separated by laterally extending fold line 114 and any other necessary fold lines. Depending on the length of article 12 and the folding configuration, the number of folded portions may vary. As illustrated in the embodiment of FIGS. 1-7, article 12 is folded such that an end of first fold portion 110 opposite fold line 114 includes a first free article end 116 and a second free article end 118, and an end of second fold portion 112 opposite fold line 114 includes a folded end 120 of article 12. In one example, article 12 is folded such that first free article end 116 and second free article end 118 are both positioned opposite and hang down from fold line 114. In this manner, free article ends 116 and 118 remain in place due to gravitational forces such that additional means of securing free article ends 116 and 118 to a remainder of article 12 and/or box 16 are not necessary in order to maintain the neat and aesthetically pleasing presentation of package product 10 as a whole.

Once folded, or while folding, a fold line, e.g., fold line 114, is placed directly over bottom segment 18 of a hanger 14. In one embodiment, to facilitate placement of fold line 114 over bottom segment 18, bottom segment 18 is rotated away from free end 36 of the first side segment 22 of hanger 14 as generally illustrated in FIG. 8. Once article 12 is properly positioned on bottom segment 18, i.e., between second side segment 24 and free end 36, box 16 is positioned relative to article 12 and hanger 14. More specifically, top panel 64 is positioned to extend directly over bottom segment 18 and just below top segment 20 of hanger 14 such that interior surface 124 of box 16 contacts and/or faces article 12. Once positioned, free end 36 of first side segment 22 is coupled with free end 42 of second side segment 24 to close hanger 14. In one example, free end 36 is coupled with free end 42 by moving pin 38 through aperture 46 of receptacle 44 until enlarged end 40 of pin 38 is positioned on the rear side of receptacle 44 selectively locking hanger 14 in a closed position.

Box 16 is then wrapped around article 12, or, in one embodiment, is wrapped around article 12 before closing hanger 14. More specifically, in one example, as illustrated with additional reference to FIG. 10, box 16 is folded downwardly from top panel 64 about each of fold lines 70 and 72 until front panel 60 and rear panel 62 extend downwardly from top panel 64 substantially parallel to one another. Each second side panel 68 is folded about fold line 76 toward front panel 60 until it extends substantially perpendicularly with respect to rear panel 62. In one embodiment, when box 16 is folded, outer side edge 92 of second side panel 68 extends toward, but not entirely to, a portion of interior surface 124 defined by front panel 60.

Figure 10:
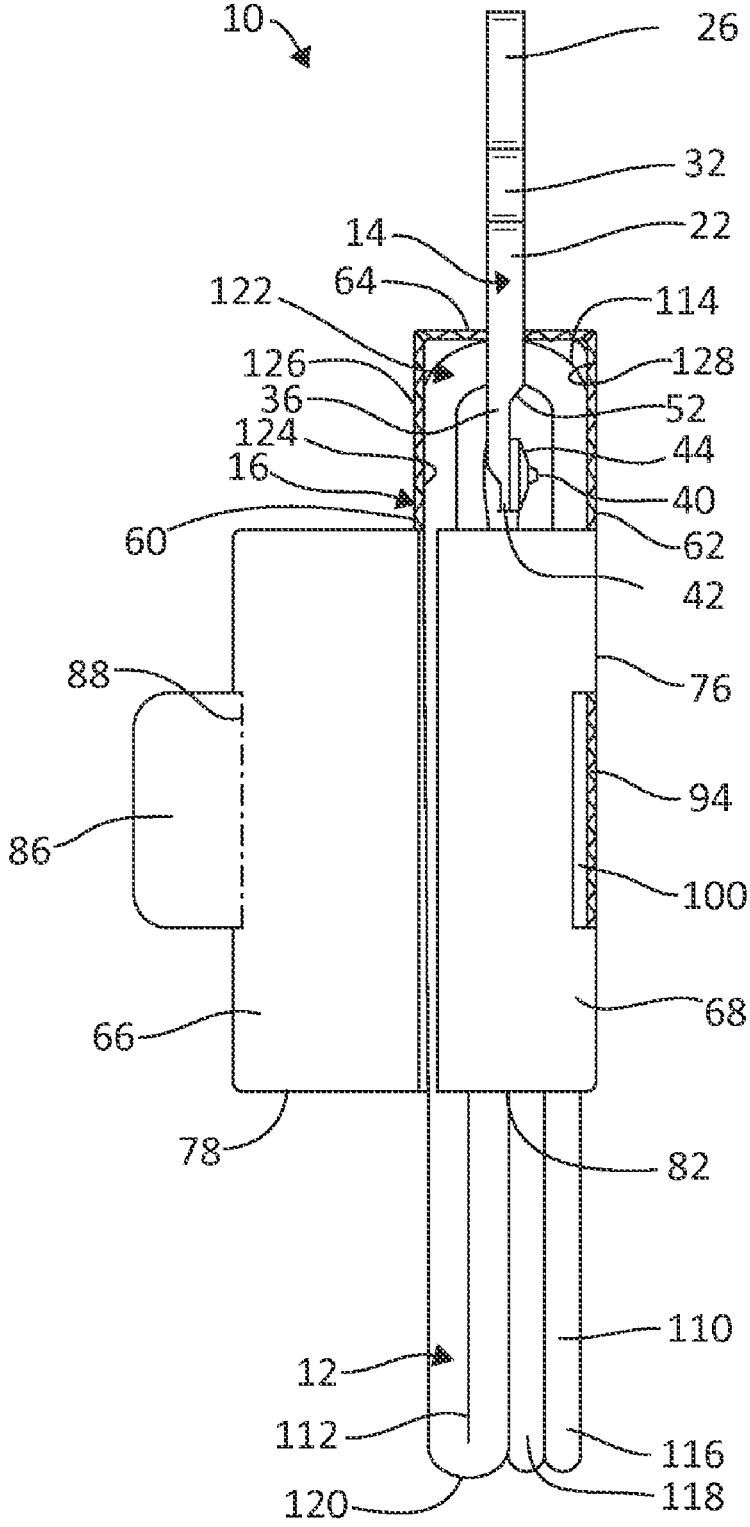
FIG. 10 is a side view of the packaged product of FIG. 1 with a partially folded box, according to one embodiment of the present invention.

Continuing to reference FIG. 10, when second side panel 68 is folded, slits 94 and 96 formed near and/or along fold line 76 define a slot 100. First side panel 66 is then folded rearwardly about fold line 74 to extend substantially perpendicularly relative to front panel 60 and to just outside first side panel 68. Tab 86 is folded about fold line 88 to extend generally perpendicularly relative to first side panel 66 and is pushed into slot 100 such that tab 86 extends into a box cavity 122 defined between front and rear panels 60 and 62. The same folding of second side panel 68, first side panel 66, and tab 86 is completed on the opposite side of box 16. In one embodiment, once folded, free edges 78 and 82 align with one another to collectively define a bottom of box 16 entirely in a single plane such that box 16 appears to continuously wrap around article 12.

Once tabs 86 are secured, box 16 is maintained in a folded position around article 12. In one embodiment, article 12 is tightly maintained by box 16 and compressed within box cavity 122 between front panel 60 and rear panel 62 to decrease shifting of article 12 relative to box 16 during shipping, transport, etc. For example, in one embodiment, a depth of folded article 12 measured from a front to a back of folded article 12 is actually decreased when compressed between front panel 60 and rear panel 62. To further secure article 12, in one embodiment, any one or more of pins, plastic tag fasteners, staples, and other connectors may be used to secure adjacent portions 110, 112, and/or any other portions to one another to further prevent or at least decrease any undesired shifting of article 12. Other variations will be apparent to those of skill in the art.

When second side panel 68 and first side panel 66 are folded and secured, a side opening 128 is formed between top free edges 80 and 84 of first and second side panels 66 and 68 and side edges 81 of front, rear, and top panels 60, 62, and 64. Side opening 128 is sized to allow bottom segment 18 of hanger 14 to laterally extend beyond side panels 66 and 68, and, in one example, is substantially rectangular in shape. In one embodiment, a perimeter of side opening 128 is collectively defined by a side edge 81, which is partially defined by each of front, rear, and top panels 60, 62, and 64, and top free edge 80 and/or top free edge 84. As such, in one example, a depth of side opening 128 is substantially equal to a depth of side panel 66 (i.e., a distance between fold line 74 and outer side edge 91) and/or a depth of top panel 64 (i.e., a distance between fold lines 70 and 72). In one embodiment, a height of side opening 128 is substantially equal to a distance between top panel 64 and top free edge 80 and/or 84 and/or is substantially equal to a distance that each of front panel 60 and rear panel 62 extend above top free edge 80. By forming an entire side opening 128 rather than just a small hole in one or both of side panels 66 and 68, box 16 is more versatile and allows for different positions of bottom segment 18 relative to top panel 64, for instance, depending on the thickness of article 12 at fold line 114. In one embodiment, the depth of side opening 128 is equal to at least about 0.5 inches, and the height of side opening 128 is equal to at least about 0.5 inches. In one example, at least one of the depth and the height of side opening 128 is equal to at least about one inch.

In addition, by leaving side opening 128 entirely open to top panel 64 and supporting hanger 14 by hook 26, gravitational forces are able to pull top panel 64 and article 12 downwardly toward bottom segment 18 such that article 12 is, in one embodiment, pinched or similarly secured between bottom segment 18 of hanger 14 and top panel 64 by compression. As such, a single sized box 16 can be used with a larger plurality of article sizes. However, one of skill in the art will recognize that the depth, length, and width of both hanger 14 and box 16 can easily be enlarged or shortened depending on the particular article 12 being displayed and/or the available space in a retail display.

The resultant packaged product 10 provides an environmentally and economically superior packaging as compared to conventional polyvinyl bags. In addition, packaged product 10 can relatively easily be reassembled if so desired by the end consumer, for example, should the consumer desire to return packaged product 10 to the store after opening packaged product 10. The clean and neat reassembly allows a returned packaged product 10 to be placed in the retail display along with other original packaged products 10 in a uniform and aesthetically pleasing manner. The display of returned or otherwise repackaged products using conventional polyvinyl bags was discouraged since any such bags generally had been torn by a consumer attempting to access the corresponding article. The resulting torn bag generally could not be neatly repackaged in an inconspicuous and/or aesthetically pleasing manner without returning the article to the original manufacturer. Therefore, for aesthetic and other reasons, it was generally undesirable to hang torn packaging on a retail display. For at least this reason, the present invention according to embodiments described herein presents a marked improvement over such prior art packaging.

Figure 11:
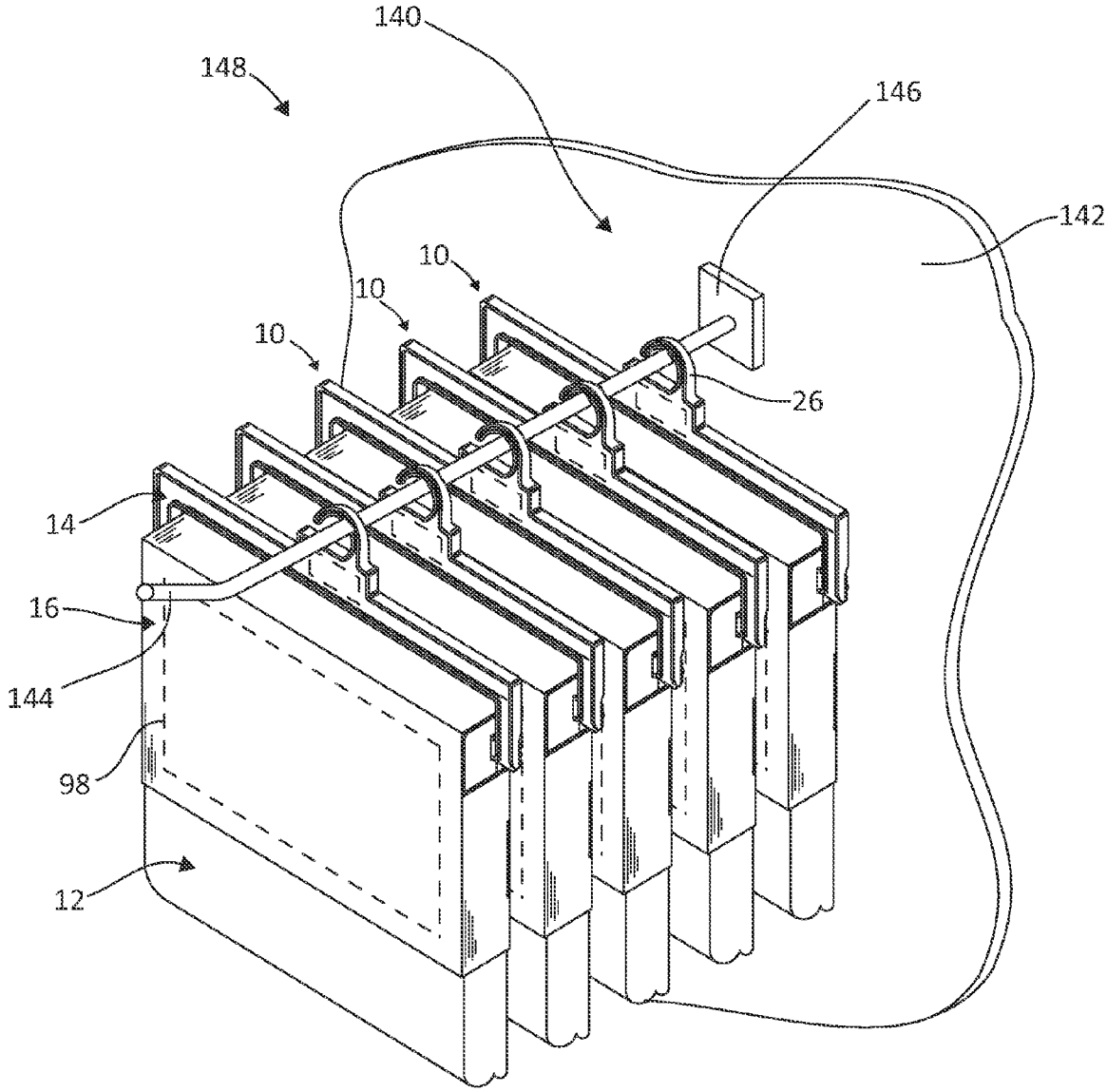
FIG. 11 is a front, perspective view illustration of a plurality of packaged products hung from a display fixture for retail display, according to the present invention.
Figure 12:
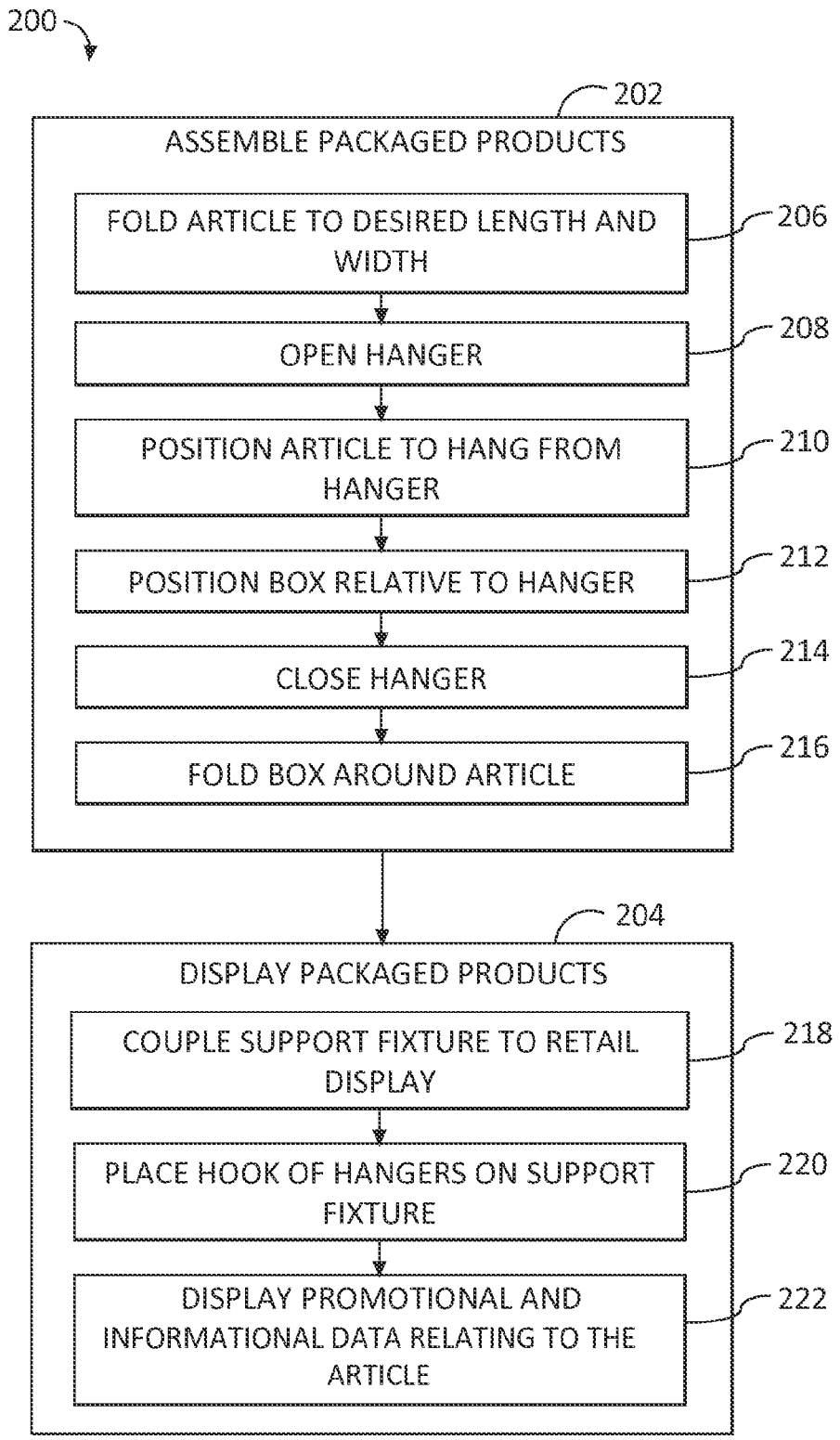
FIG. 12 is a flow chart illustrating a method of forming and displaying a packaged product, according to one embodiment of the present invention.

FIG. 12 illustrates a method of assembling and displaying one or more packaged products 10 described with respect to FIGS. 1-11. At 202, packaged product 10 is assembled. For example, at 206, article 12 is folded to a desired length and width. More specifically, as described above, article 12 is folded to a width slightly smaller than the width of front panel 60, rear panel 62, and/or top panel 64. Following folding article 12 into a desired width, article 12 is folded lengthwise into a desired length including forming at least two portions, e.g., first portion 110 and second portion 112, separated by fold line 114 and any other similar fold lines. In one example, the desired length is longer than front panel 60 and/or rear panel 62 such that a portion of article 12 hangs below box 16 allowing a potential consumer to both view and touch article 12 while viewing exterior surfaces 126 of box 16.

At 208, hanger 14 is opened, and, at 210, article 12 is placed over bottom segment 18 of open hanger 14. More specifically, hanger 14 is opened by moving free end 42 of bottom segment 18 away from free end 36 of first side segment 22. Once hanger 14 is opened, bottom segment 18 can easily be slid between first and second portions 110 and 112 of article 12, for example, just below fold line 114. At 212, box 16 is positioned relative to hanger 14. In one example, top segment 20 of box 16 is positioned just above bottom segment 18 of hanger 14 and fold line 114 of article 12. At 214, hanger 14 is closed. More specifically, free end 36 of hanger 14 is pushed toward free end 42, or vice versa, such that pin 38 is pushed through aperture 46 of receptacle 44. Once enlarged end 40 of pin 38 is positioned on the opposite side of receptacle 44, hanger 14 is selectively secured in a closed position. In one embodiment, hanger 14 is closed at 214 before either one or both of operations 210 and 212 as will be apparent to those of skill in the art upon reading the present application.

At 216, box 16 is folded around article 12. For example, as described above, second side segment 24 is folded forwardly, and first side segment 22 is folded rearwardly. Tab 86 is placed into slot 100 to secure side segments 22 and 24 in place. Once tabs 86 are secured, packaged product 10 is fully assembled such that both article 12 and box 16 hang from hanger 14, more particularly, from bottom segment 18 of hanger 14. When assembled, bottom segment 18 of hanger 14 extends through box cavity 122 and through each side opening 128 such that first and second side segments 22 and 24 each are positioned on opposite sides of article 12 and box 16. Further, top panel 64 of box 16 is positioned between article 12 and top segment 20 of hanger 14.

At 204, a plurality of fully assembled packaged products 10 is positioned in a retail store as part of a retail product display 148 (FIG. 11). In particular, for example, at 218, a support fixture or rod 144 is coupled to retail display 140, for example, to vertical wall 142 of retail display 140 via bracket 146. For example, vertical wall 142 may be a peg board surface configured to receive hooks (not shown) of bracket 146, as will be apparent to those of skill in the art upon reading this application. Support rod 144 extends from bracket 146 in a substantially horizontal manner. At 220, each packaged product 10 is hung from support rod 144 via hook 26 of the corresponding hanger 14. In particular, each of the plurality of packaged products 10 is hung from support rod 144. As such, a number of packaged products 10 can be hung in a relatively small area of retail display 140 without requiring any horizontal shelving for support.

At 222, promotional informational data relating to article 12 is displayed. For example, such data may be displayed as indicia 98 on box 16 or indicia 34 (FIG. 1) of hanger 14. In one embodiment, additional promotional informational data is provided on retail display 140, such as hung on vertical wall 142 or placed at a free end of support rod 144 as will be apparent to those of skill in the art upon reading this application. Once hung for display, article 12 is easily viewed and, if desired, tactilely observed, by a potential consumer. The ready access to article 12 increases accuracy of consumer perception of article 12 as compared to prior packaging, where article 12 would have been completely enclosed in a polyvinyl bag, and, in many instances, increases the likelihood that a consumer will purchase article 12.

In one embodiment, displaying packaged products 10 at 204 includes displaying repackaged articles 12. As described above, the selective coupling of side panels 66 and 68 to one another allow packaged product 10 to be relatively easily disassembled and reassembled. The ease of disassembly and reassembly allows an article 12 to be purchased and removed from box 16 and hanger 14 by a consumer, and to still be repackaged with box 16 and hanger 14 in the event that the consumer decides to return article 12 to the retail store. Since, upon return, the reassembled packaged product 10 appears substantially identical to original packaged products 10, any re-packaged product(s) 10 can easily be hung or displayed along side original packaged products 10 in a neat, uniform and aesthetically pleasing manner. In addition, since, in one embodiment, materials used to form at least box 16 and perhaps hanger 14 are readily recyclable, the packaging for article 12 is environmentally friendly especially as compared to the generally non-recyclable polyvinyl bags conventionally used to display similar articles.

Figure 13:
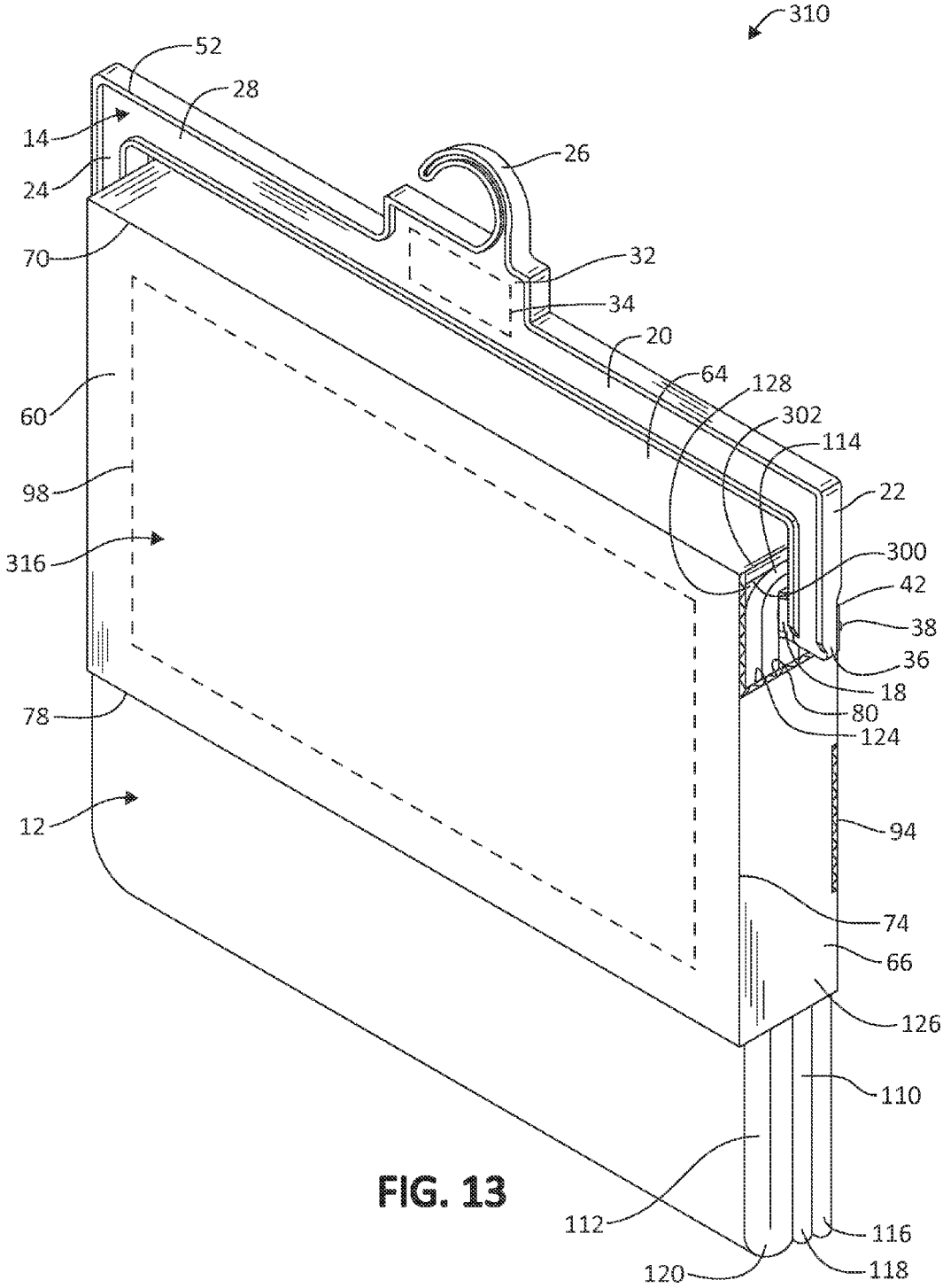
FIG. 13 is a front, perspective view illustrating a packaged product, according to one embodiment of the present invention.

FIG. 13 illustrates a packaged product 310, according to one embodiment of the present invention. Packaged product 310 is substantially similar to packaged product 10 (FIGS. 1-7) described above except where specifically enumerated herein. Packaged product 10 includes article 12, hanger 14, and a sheath or box 316. Box 316 is substantially similar to box 16 (FIGS. 1-8) as described above except where specifically enumerated herein.

Figure 14:
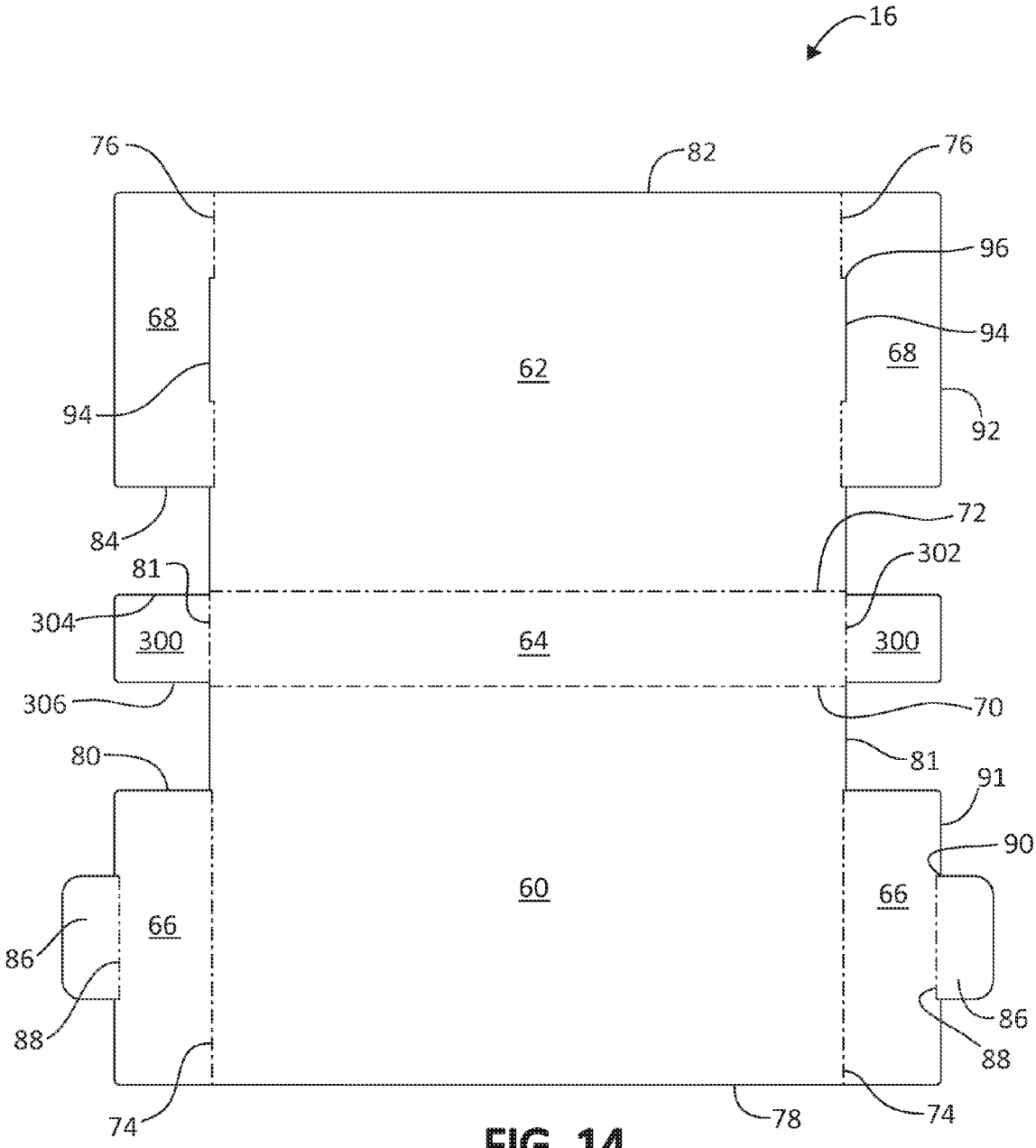
FIG. 14 is a front view of an unfolded blank for forming a box of the packaged product of FIG. 13, according to one embodiment of the present invention.

In one embodiment, as described with additional reference to the unfolded blank of box 316 illustrated in FIG. 14, box 316 includes a top flange 300 extending from each side edge 81 as part of the box blank. More specifically, in one example, top flange 300 extends laterally away from top panel 64 from a fold line 302 defined therebetween along a portion of side edge 81. In one embodiment, top flange 300 defines opposing longitudinal edges 304 and 306 such that a length of top flange 300 is defined between longitudinal edges 304 and 306. In one example, longitudinal edges 304 and 306 are each longitudinally inset from fold lines 70 and 72 a slight amount such that a length of top flange 300 is slightly less than a length of top panel 64 defined between fold lines 70 and 72.

During assembly of box 316, top flanges 300 are folded inwardly along corresponding fold lines 302 and continue to be wrapped around top panel 64 until a portion of interior surface 124 defined by each top flange 300 abuts or at least nears a portion of interior surface 124 defined by top panel 64. When so folded, top flanges 300 reinforce top panel 64 and opening 128. In one example, top flanges 300 are of particular assistance where article 12 is relative large or thick such that a wider box 316 (as measured from front panel 60 to rear panel 62) is utilized. In particular, top flanges 300 increase rigidity of top panel 64 so as to prevent or at least decrease upward bowing or bending of top panel 64 where bottom segment 18 of hanger 12 and fold line 114 of article 12 press toward top panel 64 when packaged product 10 is hung. In addition, by being folded around a portion of side edge 81 formed adjacent top panel 64, that portion of the resultant side opening 128 is reinforced in a manner prevent or decreasing the likelihood of top panel 64 tearing inwardly from side edge 81 (i.e., from side opening 128) due to forces of bottom segment 18 of hanger 12 upon top panel 64 or vice versa.

Although the invention has been described with respect to particular embodiments, such embodiments are for illustrative purposes only and should not be considered to limit the invention. Various alternatives and modifications within the scope of the invention in its various embodiments will be apparent to those with ordinary skill in the art.

What is claimed is:

1. A packaged product comprising:

a hanger including a first segment, a second segment positioned below and coupled to the first segment, and a hook extending upwardly from the first segment;

a folded article hung over the second segment of the hanger; and a sheath defining a first opposing wall, a second opposing wall, a first side wall, and a second side wall, wherein the sheath is folded around the folded article to compress the folded article between the first and second opposing walls of the sheath to decrease shifting of the folded article relative to the sheath during transport of the packaged product, the sheath defines a top wall extending between the first and second opposing walls, the top wall being substantially planar, wherein:

the top wall borders the first opposing wall along a first single, continuous fold line and the second opposing wall along a second single, continuous fold line, the top wall is disposed substantially perpendicular to the first opposing wall and the second opposing wall, the first and second side walls each extend between the first and second opposing walls such that an opening is defined between a topmost side wall edge of the first side wall, the top wall a portion of the first opposing wall extending from the first single, continuous fold line to the topmost side wall edge of the first side wall, and a portion of the second opposing wall extending from the second single, continuous fold line to a topmost side wall edge of the second side wall, and the top wall is positioned to extend over the second segment of the hanger and the folded article and below the first segment of the hanger.

2. The packaged product of claim 1, wherein the second segment of the hanger extends through the opening.

3. The packaged product of claim 1, wherein a depth of the opening is substantially equal to a depth of the sheath, and a height of the opening is substantially equal to a distance between the top wall and the topmost side wall edge of the first side wall.

4. The packaged product of claim 3, wherein the height is at least about 0.5 inch.

5. The packaged product of claim 1, wherein:

the hanger includes a first side segment and a second side segment opposite one another, the first side segment extends downwardly from the first segment to a first free end of the hanger, the second side segment extends downwardly from the first segment to the second segment, and the second segment defines a second free end of the hanger adjacent the first free end, and one of the first free end and the second free end includes a protruding pin, another of the first free end and the second free end defines a receptacle with an aperture configured to at least partially receive the protruding pin to selectively maintain the first free end coupled with the second free end.

6. The packaged product of claim 5, wherein:

the protruding pin includes an enlarged end, the receptacle defines the aperture through a center of the receptacle such that the aperture is configured to selectively deflect to receive the enlarged end of the protruding pin and to elastically return to its original shape to maintain the protruding pin in a position extending through the aperture, and the receptacle is cone shaped and defines slits extending radially outwardly from the aperture to facilitate selective deflection and enlargement of the aperture to receive the enlarged end of the protruding pin.

7. A hanging display package comprising:

a hanger defining a top segment and a bottom segment spaced from and coupled with the top segment, the hanger including a hook extending upwardly from the top segment; and a box including:

a front panel, a rear panel opposite the front panel, a top panel extending between and above the front panel and the rear panel, wherein the top panel borders the front panel along a first fold line, and the top panel borders the rear panel along a second fold line substantially parallel to the first fold line, and the top panel is substantially planar and is disposed substantially perpendicular to the front panel and the rear panel, and a side panel extending from the front panel to the rear panel to define a box cavity between the front panel, the rear panel, the top panel, and the side panel;

wherein:

the side panel defines a topmost edge, the topmost edge of the side panel is spaced below the top panel, the first fold line, and the second fold line such that a side opening is defined between the topmost edge and the top panel and such that the front panel and the rear panel each extend partially above the side panel, the bottom segment of the hanger extends through the box cavity and the side opening, and the top segment of the hanger extends above the top panel of the box.

8. The hanging display package of claim 7, wherein the front panel, the rear panel, and the side panel collectively define a bottom edge of the box, and the bottom edge of the box is entirely positioned in a single plane parallel to the top panel.

9. The hanging display package of claim 7, wherein the side opening has a depth equal to a depth of the side panel, and a height equal to a distance the topmost edge is spaced from the top panel.

10. The hanging display package of claim 9, wherein the distance is equal to at least about 0.5 inch.

11. The hanging display package of claim 7, wherein the front panel, the top panel, and the rear panel collectively define a side edge, and a perimeter of the side opening is collectively defined by the side edge and the topmost edge of the side panel.

12. The hanging display package of claim 11, wherein the box includes a top flange extending from the side edge adjacent the top panel, the top flange is folded inwardly toward the top panel to reinforce the top panel adjacent the side opening.

13. The hanging display package of claim 11, wherein:

a height of the side opening is equal to a distance the topmost edge of the side panel is spaced from the top panel, the distance is at least equal to about 0.5 inch, and the top panel extends substantially perpendicularly with respect to each of the front panel and the rear panel.

14. The hanging display package of claim 7, wherein the side panel is a first side panel, the hanging display package further comprising:

a second side panel extending from the rear panel to the front panel and positioned parallel to the first side panel, wherein the second side panel extends upwardly from a bottom edge of the box to a topmost edge of the second side panel spaced from and positioned below the top panel.

15. The hanging display package of claim 7, wherein the hanger includes a first side segment and a second side segment opposite one another, the first side segment extends downwardly from the top segment to a side free end of the first side segment, the second side segment extends downwardly from the top segment to the bottom segment, and the bottom segment defines a bottom free end adjacent the side free end.

16. The hanging display package of claim 15, wherein one of the side free end and the bottom free end includes a protruding pin, another of the side free end and the bottom free end defines a receptacle with an aperture configured to at least partially receive the protruding pin to selectively maintain the side free end coupled with the bottom free end.

17. The hanging display package of claim 16, wherein the protruding pin includes an enlarged end opposite the first side segment, and the receptacle defines the aperture such that the aperture is configured to selectively deflect to receive the enlarged end of the protruding pin and to elastically return to its original shape to maintain the protruding pin in a position extending through the aperture.

18. The hanging display package of claim 17, wherein the receptacle is cone shaped, the aperture is positioned in a center of the receptacle, and the receptacle defines slits extending radially outwardly from the aperture to facilitate selective deflection and enlargement of the aperture to receive the enlarged end of the protruding pin.

19. The hanging display package of claim 15, in combination with a flexible item for retail sale, wherein the flexible item is folded over the bottom segment of the hanger and is partially positioned between the bottom segment of the hanger and the top panel of the box, and wherein the flexible item is compressed between the front panel and the rear panel of the box to decrease shifting of the flexible item relative to the box during shipping.

20. The hanging display package of claim 7, wherein the box is formed entirely from a single-piece planar blank.

21. A method of forming an item for retail display, the method comprising:

providing an article folded for retail display;

hanging the article over a bottom segment of a hanger, wherein the hanger includes a top segment, which is spaced from the bottom segment, and a hook extending from the top segment; and placing a box around the article and the bottom segment of the hanger, the box defining a front panel, a rear panel opposite the front panel, a top panel extending between top edges of the front panel and the rear panel, the top panel being substantially planar and bordering the front panel along a first fold line and the rear panel along a second fold line substantially parallel to the first fold line the top panel being disposed substantially perpendicular to the front panel and the rear panel, a side panel extending between side edges of the front panel and the rear panel, and the side panel defining a topmost edge that is spaced below the top panel, the first fold line, and the second fold line such that an opening is defined between the topmost edge and the top panel, and the front panel and the rear panel each extend partially above the side panel, wherein placing the box around the article includes:

placing the top panel to extend over the article and between the bottom segment, and folding the box around at least a portion of the article such that a cavity is created between the front panel, the rear panel, the top panel, and the side panel and at least the portion of the article is positioned within the cavity, and the article is compressed between the front panel and the rear panel to decrease shifting of the article relative to the box during transport of the article.

22. The method of claim 21, wherein the bottom segment of the hanger extends through the box and the opening.

23. The method of claim 22, wherein:

folding the box includes folding the box from a single-piece planar blank such that the opening has a depth and a height each at least equal to about 0.5 inch and the width of the opening is substantially equal to a width of the top panel and a depth of the side panel;

hanging the article over the bottom segment of the hanger includes:

deflecting the bottom segment of the hanger away from a free end of a side segment extending from the top segment toward the bottom segment, and sliding the bottom segment of the hanger under a fold line defined by the article; and the method further comprises closing the hanger by selectively coupling the bottom segment to the free end of the side segment, wherein selectively coupling the bottom segment to the free end of the hanger includes moving an enlarged end of a protruding pin extending from one of the free end and the bottom segment through an aperture defined through a center of a cone-shaped receptacle, which is defined by another of the free end and the bottom segment, to close the hanger after folding the box around at least a portion of the article.

* * * * *